United States Patent [19]

Shamlian et al.

[11] 4,219,017

[45] Aug. 26, 1980

[54] PILOT REGULATOR

[76] Inventors: Ralph B. Shamlian, 3549 Haven Ave. #E, Menlo Park, Calif. 94025; John D. Burr, 1135 Cedarwood Way, Redwood City, Calif. 94061

[21] Appl. No.: 959,242

[22] Filed: Nov. 9, 1978

[51] Int. Cl.[2] ..... A62B 7/04

[52] U.S. Cl. ..... 128/204.26; 137/DIG. 9; 137/494; 137/491; 128/205.24

[58] Field of Search ..... 128/142.2, 142 R, 203; 137/491, 494, DIG. 9

[56] References Cited

U.S. PATENT DOCUMENTS

| | | | |
|---|---|---|---|
| 2,886,049 | 5/1959 | Holm et al. | 137/491 X |
| 3,250,292 | 5/1966 | Mollick | 137/505.41 |
| 3,285,261 | 11/1966 | Chaney | 137/491 X |
| 3,783,891 | 1/1974 | Christianson | 137/491 |
| 3,991,785 | 11/1976 | Trinkwalder, Jr. | 128/142.2 X |
| 4,015,630 | 4/1977 | Contreras | 128/142.2 X |

FOREIGN PATENT DOCUMENTS

| | | | |
|---|---|---|---|
| 1083658 | 6/1960 | Fed. Rep. of Germany | 128/142.2 |

*Primary Examiner*—Henry J. Recla

*Attorney, Agent, or Firm*—Le Blanc, Nolan, Shur & Nies

[57] ABSTRACT

An improved regulator intended primarily for use as the essential component of a SCUBA system and being a single hose, two stage regulator incorporating a novel valve subassembly in the second stage in the form of a unique main diaphragm valve and a pilot valve assembly.

19 Claims, 10 Drawing Figures

PILOT REGULATOR

BACKGROUND OF THE INVENTION

The invention relates to breathing systems in the form of single hose, two stage SCUBA regulators in general and more specifically to such regulators employing a pneumatic assist in the second stage thereof so that the regulator acts in close response to user demand and, equally importantly, has generally equivalent response parameters over a very wide range of ambient pressures and breathing gas supply pressures.

The well-known art term SCUBA is an acronym for a self contained underwater breathing apparatus and a scuba regulator is a device that supplies breathing gas to a user from a source of breathing gas under elevated pressure. Modern day scuba regulators are demand two stage, single hose regulators and include a first stage, an intermediate pressure hose and a second stage which delivers gas at ambient pressure to the diver. Typically, the first stage is attached to a tank of air or other gas under pressure of from generally 2500 psi to 4000 psi when full. The first stage reduces tank pressure to an intermediate pressure of 100 to 150 psi over ambient pressure and delivers the gas to an intermediate pressure hose. This hose is in turn connected to a second stage having an outlet with a mouthpiece for the diver. The second stage delivers air to the diver on demand at ambient pressure. An exhaust port having a one way flapper valve vents exhaled air into the water. Prior art single hose regulator second stages are typically quite simple and include a chamber having a downstream valve with a spring loaded lever arm resting against an inhalation diaphragm, a mouthpiece, and a one way flapper valve for venting exhaust. Upon inhalation, the inhalation diaphragm flexes inwardly in response to the pressure drop in the chamber created by user demand. The flexing diaphragm moves the lever to open the downstream valve to admit air from the intermediate pressure hose to the chamber and thus the diver through the mouthpiece. Upon cessation of demand by the user and/or exhalation by the diver through the mouthpiece, the inhalation diaphragm moves outwardly, allowing the lever arm to return to a normal rest position whereupon the downstream valve closes to terminate delivery of intermediate pressure air to the second stage chamber.

In a perfectly designed system, demand response of the mechanical breathing apparatus would precisely correspond to user demand on both the inhalation and exhalation phases of a breathing cycle and, additionally, a sufficient flow rate would be provided to the diver-user regardless of demand or ambient pressures. Of course, this does not happen but the principal intent of all designs is to deliver air in sufficient quantities to the diver regardless of ambient pressures and with minimum inhalation and exhalation resistance. Accordingly, optimum sensitivity of the breathing system to user demand coupled with flow capacities that will meet diver demand under normal and elevated requirements (e.g., hyperventilation) are essential criteria in the designing of an adequate SCUBA regulator.

In the present invention, breathing system sensitivity to user demand is greatly enhanced by provision of a pilot valve actuating assembly, which assists in the opening and closing of the valve delivering air to the second stage chamber. The use of pilot valve assists in breathing systems to amplify response of supply valves is, of course, not new. For example, U.S. Pat. No. 2,597,039 issued to H. Seeler on May 20, 1952 discloses a pressure breathing demand oxygen regulator particularly designed as the essential component of an aviator's high altitude mask and incorporating a control chamber having a main oxygen supply valve therein together with a pilot valve, lever linked to the inhalation diaphragm of the breathing system. Upon user demand, the lever is depressed thereby opening the pilot valve which vents control chamber pressure downstream to the user. This creates a pressure drop in the chamber which thus causes the main supply valve to open and supply oxygen to the user. A bleed line is communicated from source pressure to the control chamber so that upon cessation of user demand, the pilot valve closes; source and control chamber pressure are then equalized through the bleed line.

A similar design for an aviator's mask is disclosed in two patents assigned to the Robertshaw - Fulton Controls Company of Richmon, Virginia, these being U.S. Pat. Nos. 2,988,085 issued to L. Jones on June 15, 1961 and 3,076,454 issued to J. R. Evans et al on Feb. 5, 1963. This design also incorporates a surge chamber communicated to the main valve of the system to reduce chattering or vibration of the main valve. Typically, such chattering is an annoying problem in such designs incorporating a diaphragm valve as the main valve for supplying fluid from source to user.

The only pilot valve regulator designed for SCUBA system use known to applicant is disclosed in U.S. Pat. No. 3,783,891 issued to R. A. Christianson on Jan. 8, 1974 and assigned to Under Sea Industries of Compton, California. This system incorporates a sliding piston valve instead of a diaphragm valve as the main supply valve of the regulator second stage, the piston having a central hose communicated with a control chamber closed by an upstream pilot valve which is linked to the inhalation diaphragm of the regulator second stage. The instantly disclosed and claimed design incorporates radical departures from the Christianson patent, principally by providing a main diaphragm valve rather than a piston valve and an upstream pilot valve rather than a downstream pilot valve.

SUMMARY OF THE INVENTION

Accordingly, it is a principal object of the invention to provide a pilot valve breathing apparatus incorporating a main diaphragm valve and an upstream pilot valve which is very sensitive to user demand.

It is another object of the invention to provide a pilot regulator which is sensitive to user demand over a wide range of supply pressures and ambient pressures.

It is a further object of the invention to provide a fail safe pilot regulator which will free flow at a predetermined overpressure condition.

Yet another object of the invention is to provide a pilot regulator having a main valve body incorporating the main diaphragm valve, control chamber and pilot valve as a unitary assembly, easily removed for replacement or repair.

Still another object of the invention is to provide a pilot regulator incorporating a main diaphragm valve having a bleed orifice directly through the diaphragm to communicate with the control chamber, to thus provide a simplified, less costly and more maintenance free bleed conduit from fluid source to the control chamber of the regulator.

Still a further object of the invention is to provide a pilot regulator having a main diaphragm valve firmly sealed against movement of its periphery, limited in travel at its center and including an tapered annular valve seat in the form of spaced concentric rings of varying numbers of bores to assure prompt closing upon cessation of user demand and respond without chatter to a wide range of amounts of user demand.

Yet a further object of the invention is to provide a pilot regulator having a divided or bisected casing with main and pilot valves in one section and the inhalation diaphragm in the other section to thus create a venturi effect in the other section so that inhalation effort is reduced as demand is increased. The structure further reduces instabilities in the form of back pressure pulses in the casing by the described isolation of members.

The disclosed SCUBA regulator includes a first stage of prior art configuration, per se, an intermediate pressure hose and a second stage in the form of a generally cylindrically configured casing having an inlet passage connected to the intermediate pressure hose, an outlet passage having a mouthpiece thereon for the user-diver, a baffle bisecting the casing into two sections, a unitary, removable main valve and pilot valve subassembly in one casing section, and an inhalation diaphragm and exhaust valve located in the other casing section. The main valve and pilot valve subassembly includes a control chamber with a peripherally clamped main diaphragm valve segregating the inlet passage and control chamber, and an upstream pilot valve located in an end of the control chamber opposite the main diaphragm valve and mechanically linked to the inhalation diaphragm. The pilot valve is encased in a moving chamber designed as a sealing valve which will unseat in the event of a predetermined overpressure condition within the control chamber so that the regulator will fail safe in a free flow condition to the user. The main diaphragm has a valve seat including sets of spaced bores arranged to selectively, progressively open and close in response to diaphragm movement. An orifice is formed directly through the main diaphragm valve to communicate source pressure with the control chamber and is retained by a plate having a central opening and an off center opening, to assure source pressure-control chamber communication in the event of a seal lock between the diaphragm valve orifice and plate central opening.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings in which.

DESCRIPTION OF THE PREFERRED EMBODIMENTS

Figure 1:
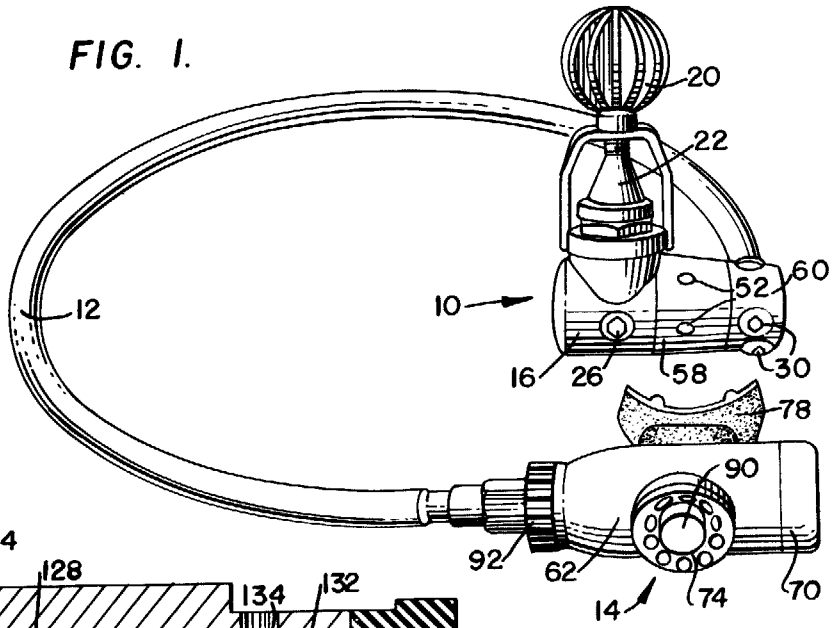
FIG. 1 is a perspective view showing the external configuration and essential components of a SCUBA regulator constructed in accordance with the principles of this invention.

A SCUBA regulator is depicted including its essential components of a first stage 10, intermediate pressure hose 12 and second stage 14.

First stage 10 includes a machined body 16, made of chrome plated brass, a yoke 18 and yoke screw 20, a dust cap 22, one or more high pressure outlet ports 24, plugged at 26 when not in use, and a plurality of intermediate pressure outlet ports 28, also plugged at 30 when not in use; intermediate pressure hose 12 is threadably connected to one of these ports 28. Typically, a submersible constant reading pressure gauge with a suitable length of hose (not shown) is threadably attached to a port 24. The gauge provides the diver with a constant reading of remaining air in his tank.

Figure 2:
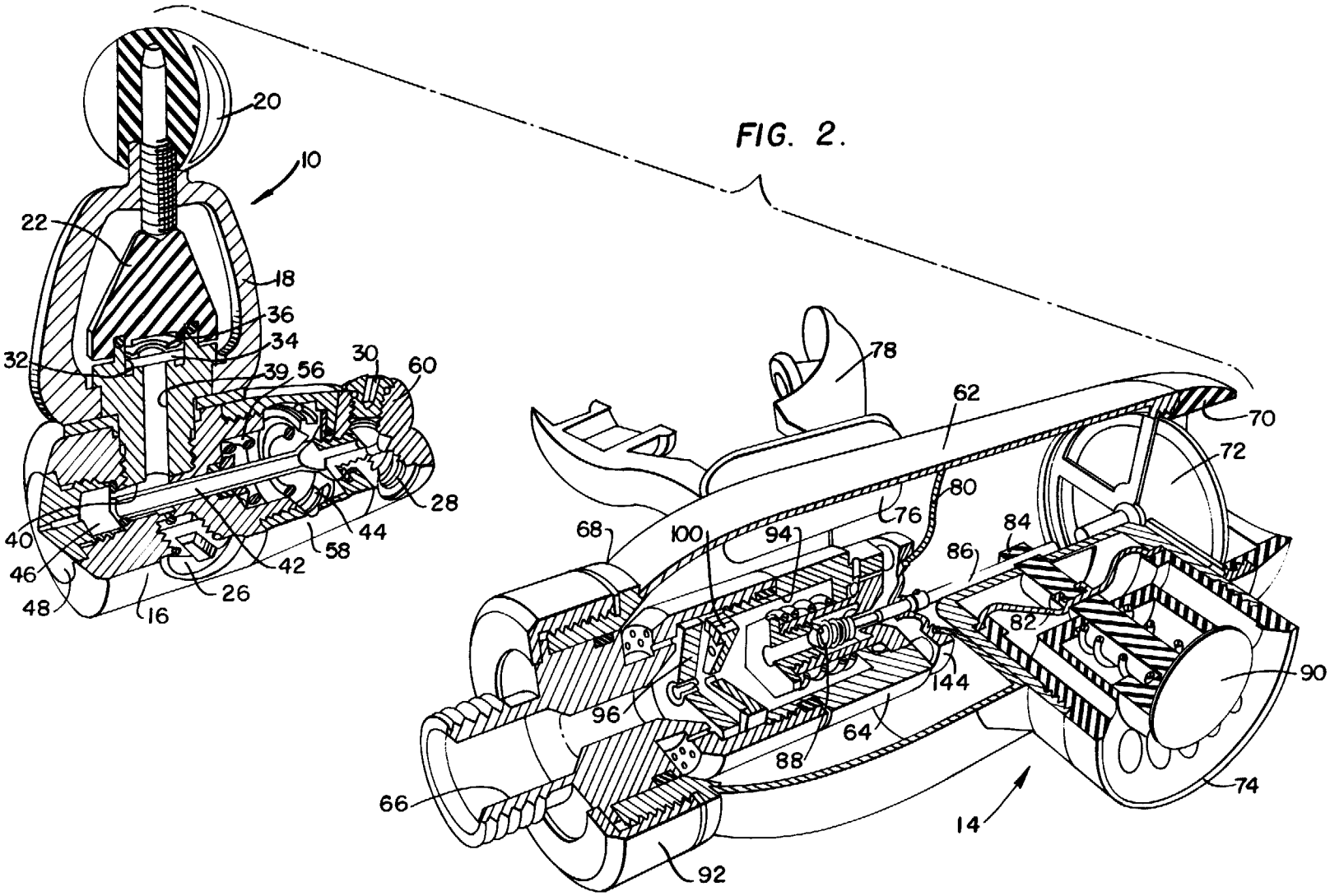
FIG. 2 is a perspective view in quarter section illustrating the first and second stages of the SCUBA regulator shown in FIG. 1, and drawn to an enlarged scale.
Figure 3:
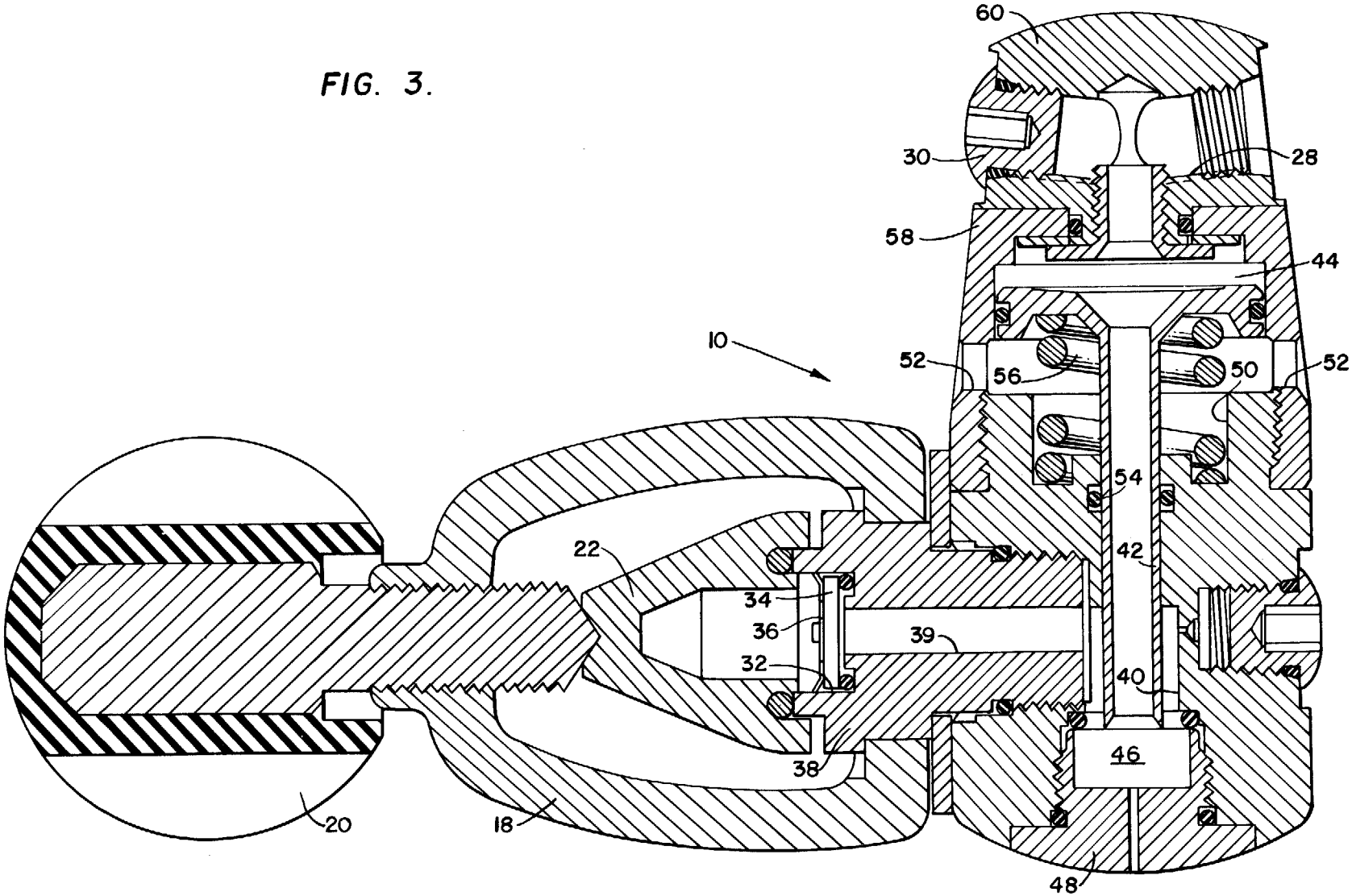
FIG. 3 is a section view of the regulator first stage depicted in FIG. 1 and drawn to a precise 2 to 1 scale of an actual embodiment of the invention.
Figure 4:
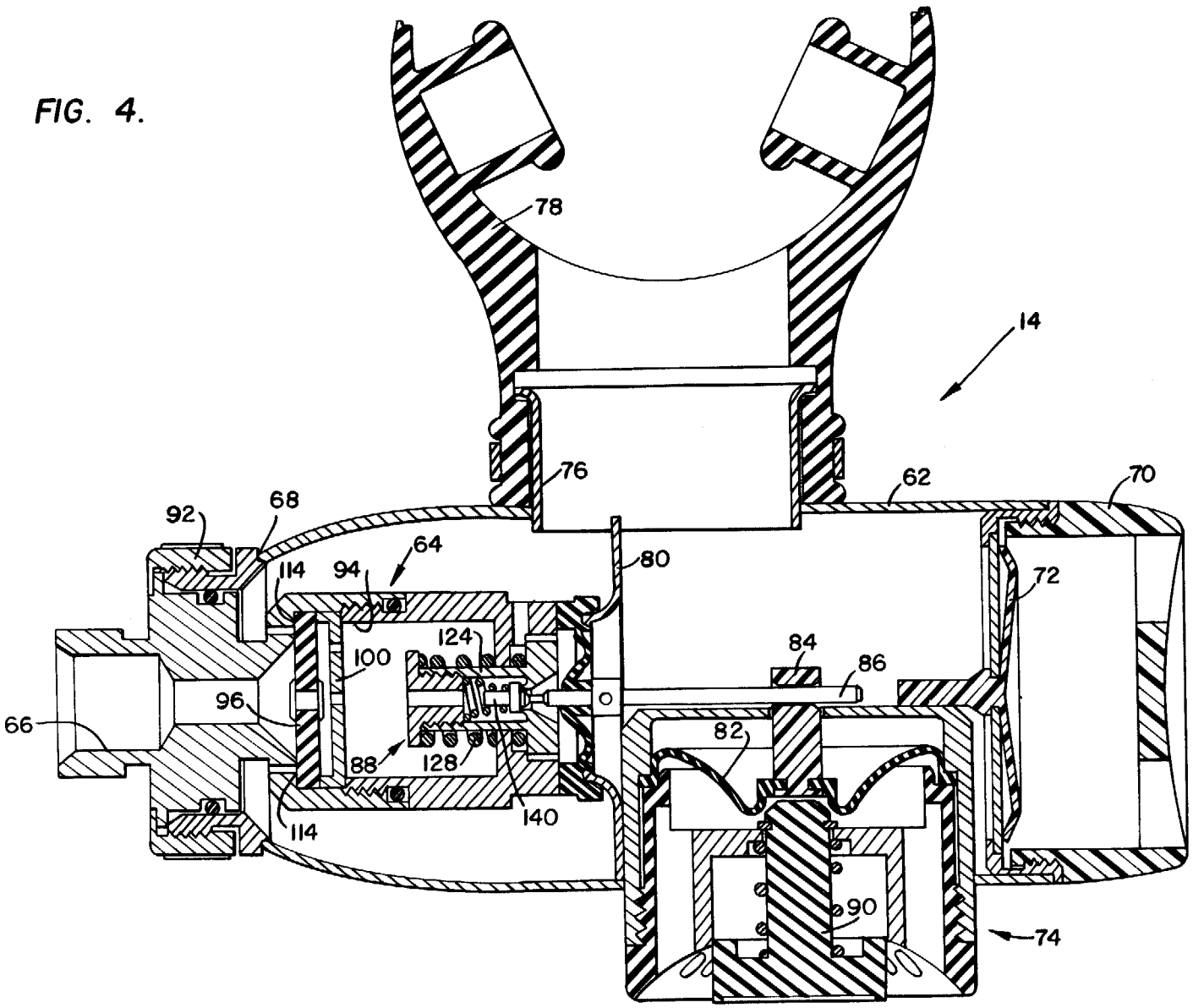
FIG. 4 is a section view of the regulator second stage depicted in FIG. 1 and also drawn to a precise 2 to 1 scale of an actual embodiment of the invention.

With the exception of the exterior configuration of first stage 10, all other components thereof are not novel per se. Turning now to FIGS. 2 and 3, the first stage 10 is attached to a SCUBA tank (not shown) by unthreading yoke screw 20, removing dust cap 22 and placing the high pressure inlet 32 against the outlet seat of the tank (not shown) and threading down yoke screw 20 to hold the tank and first stage in assembly. A sintered bronze filter 34 is retained in inlet 32 by a retaining ring 36. Yoke retainer 38 is centrally hosed at 39 to direct high pressure air to an interior high pressure chamber 40 which surrounds the hollow stem 42 of a piston 44. Stem 42 terminates in knife edge fashion against a high pressure seat 46 made of polytetrafluoroehtylene or other suitable material, located in a threaded seat retainer 48 which is removable for periodic replacement of seat 46.

At the upper end of stem 42 is a chamber 50, communicated through a series of ports 52 to ambient pressure (e.g., surrounding water). An O-ring 54 about stem 42 assures segregation of water from chamber 40. A regulator spring 56 urges piston 44 upwardly in response to downstream demand from the second stage. In addition, increasing water depth within chamber 50 results in increased ambient pressure which also urges piston 44 upwardly. Thus, upon user demand (explained below), valve seat 46 opens and intermediate pressure air, typically ambient pressure plus 130 psi plus or minus 10 psi, is then directed through stem 42 and piston 44 to an intermediate pressure port 28 and thus, through intermediate pressure hose 12 to second stage 14. The first stage 10 is depth compensated due to the exposure of the rear side of piston 44 to ambient pressure. Additionally, the first stage is a balanced valve assembly as high pressure within chamber 40 surrounds stem 42 and thus has no effect at all on the opening and closing of valve seat 46. Accordingly, effort required to move piston 44 is unaffected by tank pressure, which will vary from 4000 psi or less down to a few hundred psi as the air supply is depleted. A cap 58 houses piston 44 and is threadably attached to body 14 as shown for access to interior parts for the purpose of periodic servicing. Various unnumbered elastomer O-rings are illustrated which serve their usual sealing function and are periodically replaced. The upper end 60 of body 10 containing ports 28 is swivel mounted as illustrated in FIG. 3 so that the intermediate pressure hose may be positioned as desired by the diver-user.

Referring now to FIGS. 2 and 4–6, the construction and operation of second stage 14 will be discussed in detail. Second stage 14 includes a generally cylindrically configured casing 62, also made of chrome plated brass. A main diaphragm valve and pilot valve subassembly 64 (illustrated above in FIG. 5) having an inlet passage 66 is mounted at an inlet 68 end of casing 62 and an exhaust cap 70 with a one way flapper valve 72 therein is mounted in an opposed, open end of casing 62. An inhalation control diaphragm assembly 74 is also located in the main body of casing 62, generally opposite an outlet passage 76 for the diver-user, having a mouthpiece 78 thereon.

Casing 62 is essentially bisected by a baffle 80 which divides casing 62 into two interior sections, one containing subassembly 64 and the other containing exhaust cap 70 and diaphragm assembly. Thus, air directed into the casing from subassembly 64 will, in the main, pass directly to the diver-user through mouthpiece 78. This configuration not only eliminates potential instabilities as a result of back pressure pulses within casing 62 but also creates an aspirator or venturi effect in the right hand section (FIG. 4) of casing 62 to thus reduce inhalation effort as diver-user demand increases.

Inhalation control diaphragm assembly 74 includes a diaphragm 82 which flexes inwardly when a pressure drop occurs within casing 62 in response to user demand. A pilot valve lever control guide 84 extends centrally inwardly from diaphragm 82 and is cross bored to receive a pilot valve control lever 86 extended from pilot valve 88 of subassembly 64. A spring loaded purge button 90 is mounted within diaphragm assembly 74 so that the diver may merely press button 90 to vent air into casing 62. Unitary subassembly 64 is mounted within casing 62 at casing inlet 68 by a threaded collar 92 and is thus easily removed for servicing or replacement.

Figure 5:
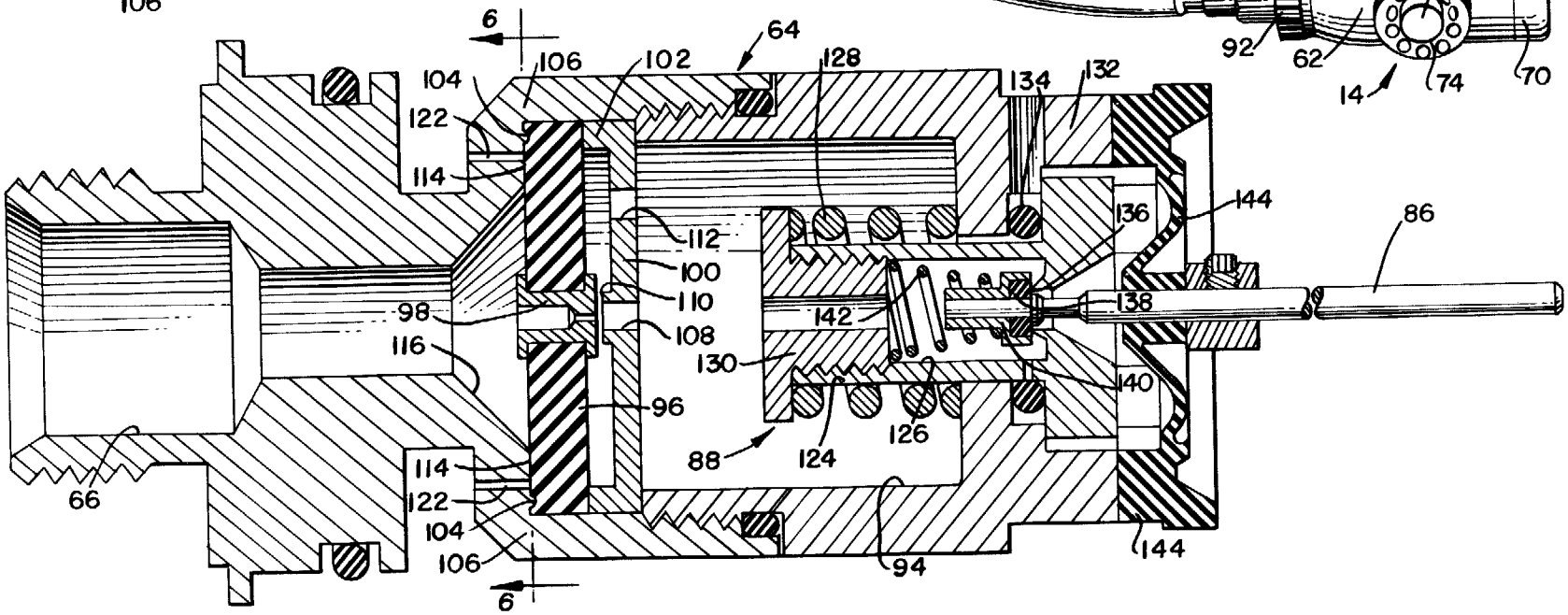
FIG. 5 is a section view of the valve body, main diaphragm valve, control chamber and pilot valve unitary, removable subassembly of the second stage shown in FIG. 4 but drawn to a precise 4 to 1 scale of an actual embodiment of the invention.
Figure 6:
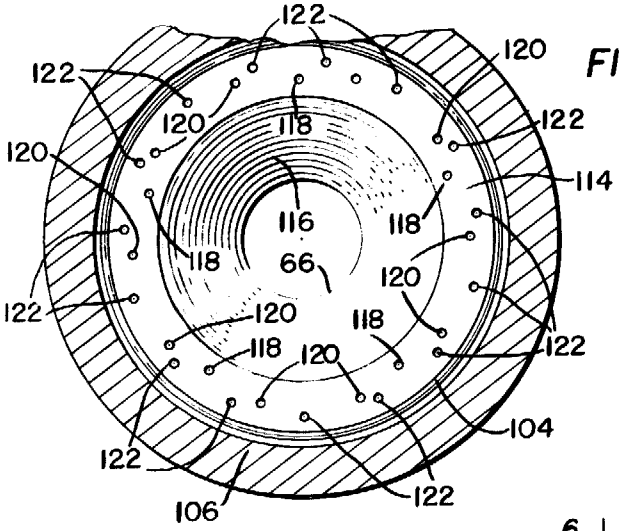
FIG. 6 is a section view taken along lines 6—6 of FIG. 5.

Referring now to FIGS. 5 and 6, subassembly 62 includes a control chamber 94 segregated from inlet passage 66 by a main diaphragm valve 96 at one end and closed at the other end by pilot valve assembly 88. Diaphragm valve 96 is an elastomer diaphragm with a vulcanized stainless steel bleed orifice 98 located centrally therein to communicate air from passage 66 to control chamber 94. Valve 96 is tightly clamped about its periphery to one end of control chamber 94 by a clamping plate 100 having a raised circumferential edge 102 and by a raised circumferential edge 104 formed in a peripheral section 106 in the one end of control chamber 94. Plate 100 further includes a bore 108 formed centrally therein, aligned with orifice 98, and a raised edge 110 which limits center travel of diaphragm valve 96. This structure limits diaphragm valve 96 so as not to exceed its elastic limit and further assures prompt shut off upon return of diaphragm valve 96 to a stable, non-flow position. Plate 100 further includes a second, off center bore 112 to prevent a seal occurring between orifice 98 and bore 108 which would result in free flow to casing 62.

Turning now to FIG. 6, valve seat 114 for diaphragm valve 96 will be explained in detail. The seat is formed on section 106 between edge 104 and a 45° counter bore 116 in passage 96 and comprises three concentric sets or rings 118, 120 and 122 of 5 bores, 10 bores and 15 bores progressing outwardly as shown. Additionally, seat 115 is tapered upwardly from outside towards the center of diaphragm valve 96 at an angle of about 3°. This structure permits a progressively larger but controlled flow as demand increases in that as diaphragm valve 96 moves off of seat 114, a larger number of holes are thus exposed to effect greater flow to casing 62 and thus outlet 76.

Pilot valve assembly 88 includes a body member 124 forming a chamber 126 therein and surrounded, interiorally of chamber 94, with a pressure relief spring 128 held by a retainer 130. Body member 124 is headed at 132 and sealed to chamber 94 by O-ring 134. Member 124 is axially slidable against pressure exerted by spring 128, in the event of an overpressure condition within chamber 94 so as to break the seal of O-ring 134 and permit air to free flow into casing 62. Normally, the spring is loaded to relieve at 150% of a predetermined control chamber pressure.

The pilot valve itself is an upstream tilt valve and includes a knife edge opening 136 against a seat 138. A pilot seat retainer 140 is spring compressed to a stable pilot valve closed condition by spiral spring 142.

An elastomer seal ring 144 is located about lever 86 and serves to direct air flowing from open pilot valve port 144 back towards the left side of casing 62 (FIG. 4) by forming a seal against the baffle 80. This further enhances the venturi flow effect discussed above. Additionally, seal ring 144 is made soft enough so as not to substantially increase inhalation effort by adding significant resistance to control lever 86 travel.

Figure 7A:
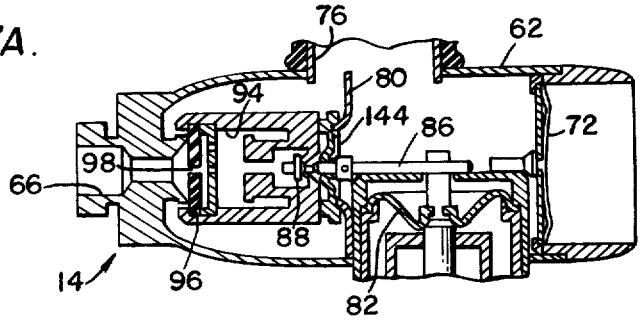
FIGS. 7A, 7B, 7C and 7D are diagrammatic, section views of the second stage of the regulator as shown in FIG. 4 and illustrating the positioning of interior components of the regulator second stage during a breathing cycle consisting of, in sequence: at rest or stable; initial inhalation causing pilot valve actuation; continued inhalation with both main diaphragm valve and pilot valve actuation; and exhalation, with pilot valve closing and control chamber pressure equalization with source pressure.
Figure 7B:
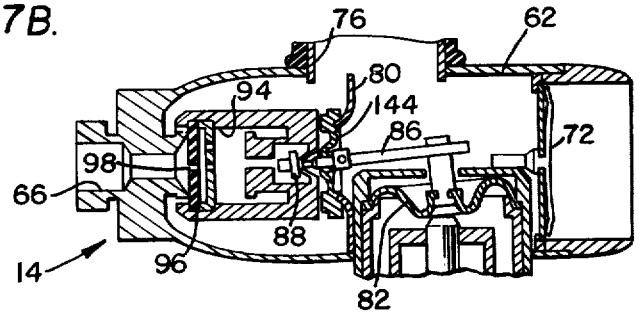
Figure 7C:
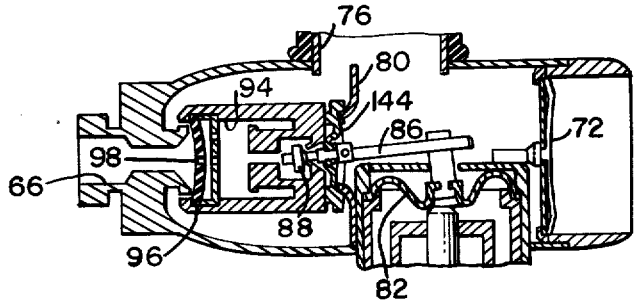
Figure 7D:
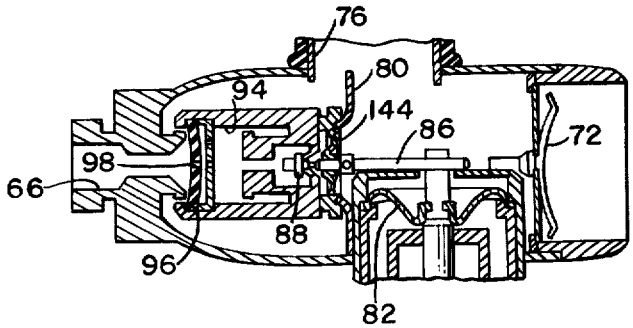

Referring now to FIGS. 7A through 7D, the relationship and movement of parts during a breathing cycle will be set forth. FIG. 7A depicts all parts at rest, valves closed and thus no flow occuring. FIG. 7B illustrates the initiation of an inhalation by the diver-user through outlet passage 76. Inhalation diaphragm 82 is flexed inwardly thus moving control lever 86 and opening pilot valve 88. Air thus flows from control chamber 94 into casing 62 thereby initiating a reduced pressure condition within chamber 94.

Once this occurs, main diaphragm valve 96 is caused to flex inwardly and open, as illustrated in exaggerated fashion in FIG. 76. Air is deflected by seal ring 144 and baffle 80 substantially directly into outlet passage 76 to enhance the venturi or aspirating feature of the regulator as discussed above. When the diver-user exhales, diaphragm 82 is flexed outwardly to close pilot valve 88 and the diver's exhalation bubbles out of one way flapper valve 72 into the water. With the closing of pilot valve 88, control chamber 94 equalizes with the pressure from inlet passage 66 through orifice 98 of main diaphragm valve 96, which then closes under assist from its own elastic memory.

Tests of the regulator have been conducted. Typically the inhalation effort does not exceed 3.5 cm of $H_2O$ down to 200 feet at a normal breathing rate of 15 breaths per minute, tidal volume of 3 liters. At a tank pressure of 2000 psi, the second stage 14 will produce 30 cubic feet per minute (cfm), at 1200 psi, 26 to 27 cfm, and at 300 psi, 20 cfm. Typically, 10–12 cfm would be an extraordinary high demand by the diver-user. In addition, the regulator has a maximum output of 90 liters per minute which is extraordinarily high and thus above any demand that could be created.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A breathing apparatus for supplying fluid under pressure to a user on demand and at ambient pressure comprising: a casing; an inlet passage in said casing for receiving fluid under pressure; an outlet passage in said casing for supplying fluid to a user on demand; a valve body within said casing and communicated with said inlet passage; means defining a control chamber within said valve body; an elastomer diaphragm valve at one end of said control chamber segregating said inlet passage from said control chamber; a pilot valve assembly mounted within said control chamber at an end generally opposite said one end; a diaphragm in said casing responsive to user demand; means interconnecting said casing diaphragm and pilot valve assembly whereby upon user demand sensed by said casing diaphragm said pilot valve is opened; means communicating fluid from said inlet passage to said control chamber; and means defining a valve seat for said diaphragm valve within said control chamber and communicated with said casing and thus said outlet passage, said means defining a valve seat including a predetermined configuration of a plurality of openings comprising a series of bores of predetermined size and number positioned on said valve seat such that when said elastomeric diaphragm valve moves away from said valve seat, said bores are progressively and non-simultaneously opened to provide greater volume of flow as a direct function of user demand, whereby, in response to user demand, said pilot valve is opened to reduce pressure within said control chamber thereby causing said valve diaphragm to open and supply fluid to the user through both said pilot valve assembly and said diaphragm valve and, at the termination of user demand, said pilot valve closes, pressure in said control chamber equalizes with source pressure through said fluid communicating means and said diaphragm valve closes in response to said control chamber pressure and by virtue of its own elastic memory.

2. The breathing apparatus as claimed in claim 1 wherein said valve body is generally cylindrical in configuration, said valve body, diaphragm valve, diaphragm valve seat and pilot valve assembly comprising a unitary assembly mounted with said casing at said casing inlet passage.

3. The breathing apparatus as claimed in claim 1 wherein said diaphragm valve is a downstream valve and said pilot valve is an upstream tilt valve.

4. The breathing apparatus as claimed in claim 3 wherein said pilot valve assembly includes a movable chamber housing said pilot valve assembly therewithin and being slidable axially within said control chamber through said opposite end thereof, said control chamber further comprising sealing means between said control chamber opposite end and said pilot valve assembly chamber, and spring means urging said pilot valve assembly chamber into engagement with said sealing means, said spring means being of a predetermined load whereupon in the event of a predetermined overpressure condition existing within said control chamber, said pilot valve assembly chamber will move away from said sealing means to bleed overpressure fluid into said casing.

5. In a breathing apparatus for supplying fluid under pressure to a user on demand and at ambient pressure, the breathing apparatus including a casing having an inlet for fluid under pressure, and an outlet for a user: a pilot valve and main valve assembly within said casing and connected to the inlet comprising a control chamber within said assembly, a main diaphragm valve subassembly segregating said control chamber from the breathing apparatus inlet, a pilot valve subassembly located within said control chamber at an end thereof opposite said diaphragm valve and means communicating fluid from said inlet to said control chamber whereby, in response to user demand, said pilot valve is opened to reduce pressure within said control chamber to open said main diaphragm valve and, upon termination of user demand, said pilot valve closes, pressure in said control chamber equalizes with inlet pressure through said fluid communicating means and said main diaphragm valve closes in response to control chamber pressure and by virtue of its own elastic memory, said pilot valve subassembly further including a movable chamber housing said pilot valve therewithin and being slidable axially within said control chamber through said opposite end thereof, said control chamber further comprising sealing means between said control chamber opposite end and said movable chamber of said pilot valve subassembly, and spring means urging said pilot valve subassembly chamber into engagement with said sealing means, said spring means being of a predetermined load whereupon in the event of a predetermined overpressure condition existing within said control chamber, said pilot valve subassembly chamber will move away from said sealing means to bleed overpressure fluid into said casing.

6. The breathing apparatus as claimed in claim 4 or 5 wherein said spring means is loaded to permit said pilot valve assembly chamber to move away from said sealing means when the pressure within said control chamber exceeds 150 percent of a predetermined pressure.

7. The breathing apparatus as claimed in claim 1 wherein said means communicating fluid from said inlet passage to said control chamber comprise a diaphragm valve orifice in the form of a stainless steel member having a bore centrally therethrough, said stainless steel member being vulcanized to said elastomer diaphragm valve.

8. The breathing apparatus as claimed in claim 1 wherein said valve body is generally cylindrical in configuration and said diaphragm valve is generally circular in configuration, said valve body further comprising means for immovably locking the periphery of said diaphragm valve within said valve body.

9. The breathing apparatus as claimed in claim 8 wherein said clamping means comprise a circumferential seat within said valve body on the downstream side of said diaphragm valve, a circular raised ring having a sharp periphery formed on said circumferential seat, and a circular clamping plate on the upstream side of said diaphragm valve having a raised peripheral edge cooperating with said raised ring to lock the periphery of said diaphragm valve therebetween.

10. The breathing apparatus as claimed in claim 9 wherein said means communicating fluid from said inlet passage to said control chamber comprise an orifice formed directly through said diaphragm valve, said clamping plate further comprising means defining a central opening therethrough aligned and cooperating with said diaphragm valve orifice for passage of fluid under pressure to and from said control chamber, and additional means defining a second opening through said clamping plate, being located off center with respect to said central opening, to prevent a fluid seal from being created between said diaphragm valve orifice and said clamping plate central opening during fluid flow.

11. The breathing apparatus as claimed in claim 10 wherein said central opening further includes means defining a raised periphery thereabout, on said clamping plate, the height of said periphery being predetermined to limit travel of the center portion of said diaphragm valve so as not to exceed the elastic limit of said diaphragm valve and further to assure prompt seating and shut off of said diaphragm valve on its valve seat.

12. The breathing apparatus as claimed in claim 8 wherein said valve seat for said diaphragm valve is formed as an annular ring, located in said valve body concentrically inwardly of said diaphragm valve periphery on a side opposide said control chamber, said plurality of openings comprising a series of at least three concentrically arranged, spaced sets of bores of predetermined size and number.

13. The breathing apparatus as claimed in claim 12 wherein said spaced sets of bores of predetermined size and number comprise a first, interior set of five bores, a second set outwardly of said first set, of ten bores and an outermost set of fifteen bores.

14. The breathing apparatus as claimed in claim 12 wherein said annular ring configured valve seat is tapered upwardly from said diaphragm valve periphery towards the center of said diaphragm valve at an angle of about 3 degrees with respect to a plane drawn at right angles to a center axis through said valve body and diaphragm valve.

15. The breathing apparatus as claimed in claim 1 wherein said casing further comprises a baffle dividing said casing into two sections, one containing said valve body and the other having said casing diaphragm located therein, both of said sections being in communication with said outlet passage.

16. A breathing apparatus for supplying fluid under pressure to a user on demand and at ambient pressure comprising: a casing; an inlet passage in said casing for receiving fluid under pressure; an outlet passage in said casing for supplying fluid to a user on demand; a valve body within said casing and communicated with said inlet passage; means defining a control chamber within said valve body; an elastomer diaphragm valve at one end of said control chamber segregating said inlet passage from said control chamber; a pilot valve assembly mounted within said control chamber at an end generally opposite said one end having an inlet communicating with said control chamber and an outlet communicating with said outlet passage; a diaphragm in said casing responsive to user demand; means interconnecting said casing diaphragm and pilot valve assembly whereby upon user demand sensed by said casing diaphragm said pilot valve is opened; means communicating fluid from said inlet passage to said control chamber; and means defining a valve seat for said diaphragm valve within said control chamber and communicated with said casing and thus said outlet passage whereby, in response to user demand, said pilot valve is opened to reduce pressure within said control chamber thereby causing said diaphragm valve to open and both, said pilot valve and said diaphragm valve supply fluid to the user and, at the termination of user demand, said pilot valve closes, pressure in said control chamber equalizes with source pressure through said fluid communicating means and said diaphragm valve closes in response to said control chamber pressure and by virtue of its own elastic memory, said casing further comprising a baffle dividing said casing into two sections, one containing said valve body and the other having said casing diaphragm located therein, both of said sections being in communication with said outlet passage, said baffle being positioned to deflect substantial fluid flow from both said diaphragm valve and said pilot valve to said outlet passage rather than to said second section.

17. The breathing apparatus as claimed in claim 15 or 16 wherein said baffle further comprises a central, elastomer deflector plate downstream of said pilot valve within said first section, whereby said baffle and plate are positioned to deflect substantial fluid flow from both said diaphragm valve and said pilot valve to said outlet passage rather than to said second section.

18. The breathing apparatus as claimed in claim 1 wherein said apparatus comprises the second stage of a SCUBA system two stage, single hose regulator, said inlet passage being connected to the outlet end of the intermediate pressure hose of said regulator and said outlet passage including a mouthpiece for a user.

19. The breathing apparatus as claimed in claim 18 comprising, in combination, a SCUBA regulator including a first stage, and an intermediate pressure hose.

* * * * *